United States Patent [19]

Bergh

[11] 4,377,923

[45] * Mar. 29, 1983

[54] SURFACE TREATING APPARATUS

[75] Inventor: John C. Bergh, Elkhart, Ind.

[73] Assignee: Wheelabrator-Frye Inc., Hampton, N.H.

[ * ] Notice: The portion of the term of this patent subsequent to Aug. 17, 1993, has been disclaimed.

[21] Appl. No.: 655,787

[22] Filed: Feb. 6, 1976

[51] Int. Cl.[3] ..... B24C 9/00

[52] U.S. Cl. ..... 51/424

[58] Field of Search ..... 51/9 M, 424, 428, 429

[56] References Cited

U.S. PATENT DOCUMENTS 3,034,262 5/1962 Pawlson ..... 51/9 M
3,380,196 4/1968 Mabille ..... 51/9 M
3,608,968 9/1971 Burnett ..... 51/9 M X
3,900,969 8/1975 Diehn ..... 51/9 M

*Primary Examiner*—James G. Smith
*Attorney, Agent, or Firm*—McDougall, Hersh & Scott

[57] ABSTRACT

A portable apparatus for treatment of surfaces, preferably horizontal, comprising a centrifugal wheel for projecting abrasive particles onto the surface of an angle within the range of 30° to 80° with the surface, a feed hopper for supplying abrasive particles to the wheel, a rebound corridor extending angularly upwardly through an angle of at least 180° with the surface and through which the abrasive particles rebound upon striking the surface whereby gravity means take over for returning the rebounding abrasive particles to the hopper.

9 Claims, 2 Drawing Figures

SURFACE TREATING APPARATUS

This invention relates to a device for treatment of surfaces with particulate material thrown at high velocity onto the surface and it relates more particularly to a portable device which makes use of one or more wheels having radially extending blades for throwing, by centrifugal force, particulate material, such as steel shot, grit, or abrasive particles against the surface for cleaning, abrading, or other surface treatment.

Recovery for re-use of abrasive or other particulate material is essential to the commercial operation of the device, otherwise the cost of particulate material or abrasive becomes excessive; the means for supplying of the large volumes of abrasive material imposes problems of size and weight, and the means for disposal of spent abrasive material increases the problems.

Recovery of particulate material and abrasives entails the problems of removal of spent particulate material and abrasive from the surface, separating re-usable particulate material and abrasive from the dust, dirt and fines picked up from the surface, and returning the cleaned particulate material or abrasive for recycle to the centrifugal blasting wheel for re-use in surface treatment.

Such recovery, cleaning and recycle of cleaned particulate material and abrasive should be embodied in a unit with the centrifugal wheels and chambers if the unit is intended for use as a portable surface cleaning or treating device.

Present surface treatment devices which combine such units especially for the treatment of horizontal surfaces, such as floors, ships' decks, roads, runways and the like, are very large and difficult to maneuver in relatively small areas. A great deal of the length and weight is taken up by the recovery, cleaning and recycle system for recycling the used particulate material or abrasive.

It is an object of this invention to provide a portable surface treating device of the type described which is of a size and weight to be easily maneuverable over the surface to be cleaned or otherwise treated, in which simple and efficient means are utilized for recovery of the re-usable abrasive or other particulate material, in which the recovered abrasive or particulate material is cleaned and recycled as feed to the centrifugal throwing wheel in a manner which requires a minimum of space and additional equipment, and in which the abrasive or other particulate material is substantially completely removed from the cleaned or treated surfaces thereby to minimize the loss of material, and the amount of additional cleaning required to remove the dust and residue from the cleaned or treated surface.

Figure 1:
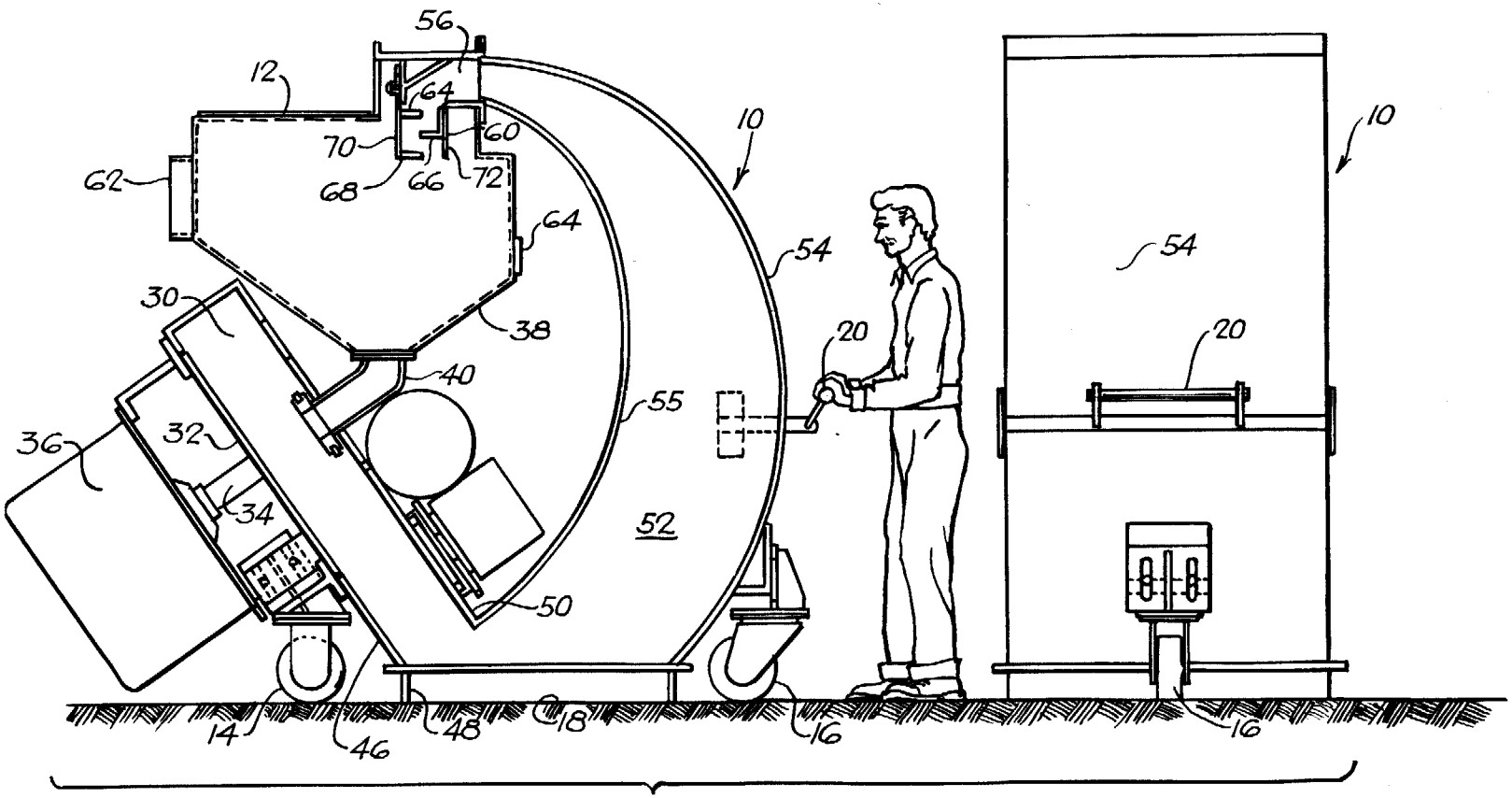
Figure 2:
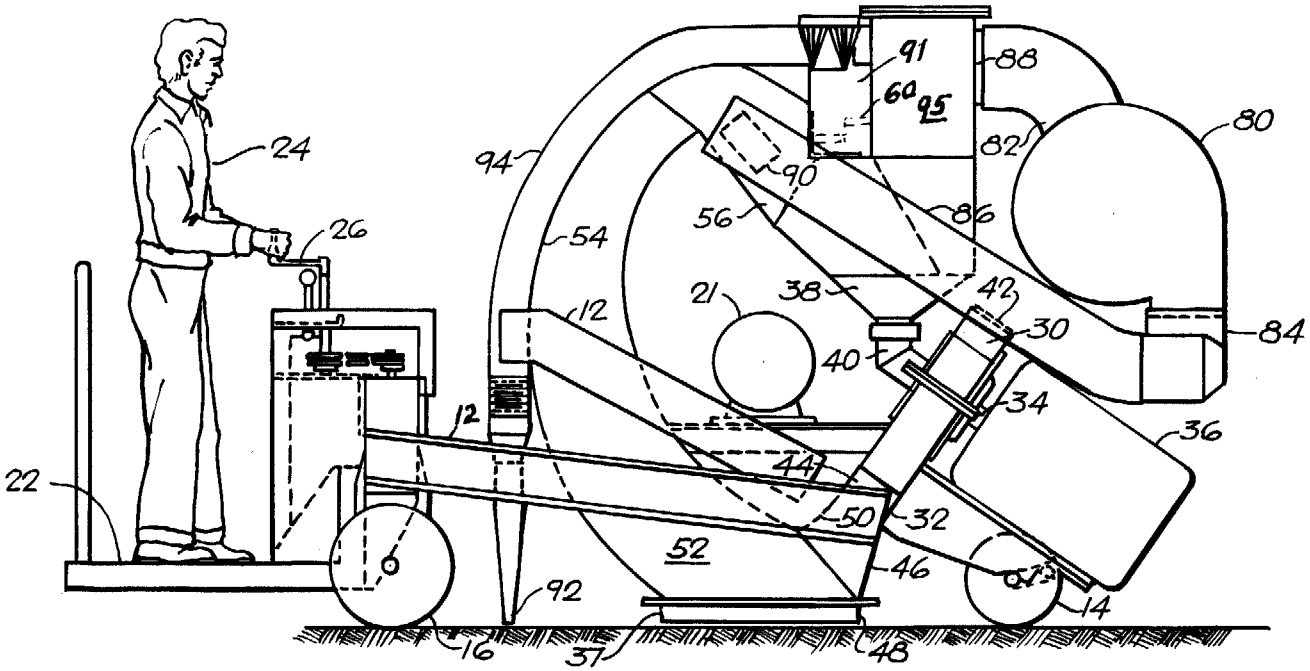

These and other objects and advantages of this invention will hereinafter appear and for purposes of illustration, but not of limitation, an embodiment of the invention is shown in the accompanying drawings, in which FIG. 1 is a schematic sectional elevational view showing the essential elements of a portable apparatus embodying the features of this invention for cleaning a floor, ship's deck, or other horizontally disposed surface; and FIG. 2 is an elevational plan view showing a slight modification in the apparatus of FIG. 1.

The invention will be described with reference to an apparatus for cleaning a horizontally disposed, relatively flat surface, such as a floor, ship's deck, airport runway, street and the like, but it will be understood that the apparatus to be described has application also for the treatment of surfaces other than flat and other than horizontal, such for example as a rolling surface, inclined surface and even a vertical surface.

While the invention will hereinafter be described with reference to the use of hard abrasive particles for cleaning such surfaces, it will be understood that the apparatus of this invention has application for the treatment of surfaces with other particulate material for use in cleaning surfaces, removal of surface finishes, hardening surfaces as by peening or impacting, and for providing certain finishes to a metal, plastic, wooden and the like surface. The type of surface treatment or finish depends somewhat upon the type of particulate material projected onto the surface such as steel shot, steel grit, metal abrasive, sand for surface cleaning, or softer materials such as particulate organic materials in the form of nut shells, nut seeds, wooden or plastic particles and the like for surface finishing, hereinafter collectively referred to as abrasive particles.

Referring now to the drawings, illustration is made of an apparatus 10 which includes a rigid frame 12 mounted on frame wheels 14, and a caster wheel 16 for enabling movement of the apparatus in various directions over the surface 18 to be treated. The apparatus may be adapted for movement by hand, in which event handle bars 20 are provided to extend rearwardly from the frame, or the apparatus may be powered for movement over the surface, as by means of a hydraulic motor drive 21, in which event a platform 22 is provided to extend rearwardly from the frame and on which the operator 24 rides, with steering means 28 connected to caster wheel 16 for maneuvering the apparatus over the surface to be treated.

The apparatus 10 is provided with one or more centrifugal wheels 30 enclosed within a protective housing 32. The wheel 30 is generally referred to as a centrifugal blasting wheel, of the type well known to the trade, and marketed by Wheelabrator-Frye Inc. of Mishawaka, Indiana, under the name WHEELABRATOR. The wheel is rotated at high speed on an axle 34 driven by an electrical motor 36. Instead of a direct motor drive, rotational movement at high speed can be imparted to the wheel by means of a belt drive which interconnects a pulley on the end of the axle with a motor driven sheave offset from the wheel axis.

Abrasive particles are fed from a supply hopper 38 through a feed spout 40 to a cage in the center of the wheel. The cage dispenses the abrasive particles onto the inner end portion of the blades 42 which extend radially outwardly in circumferentially spaced relation from the hub whereby, in response to rotational movement of the wheel, the abrasive particles are displaced radially outwardly over the surfaces of the blades and thrown with high centrifugal force from the ends of the blades in a direction controlled by the cage. The rate of flow of particulate material is controlled by a control valve in the feed system.

As illustrated in FIGS. 1 and 2, the wheel axle is inclined so that the abrasive particles will be thrown from the blades angularly downwardly through a similarly inclined blast corridor 44 onto the surface 18. The cleaning efficiency and rebound of the abrasive particles, for best recovery, is somewhat dependent upon the angle of inclination at which the abrasive particles strike the surface which angle corresponds to 90° minus the angle of inclination that the wheel axle makes with the horizontal. The angle of inclination that the wheel axle makes with the horizontal should be less than 60° and not less than 10° so that the angle at which the abrasive particles strike the surface will not be less than 30° nor greater than 80° and preferably within the range of 45° to 65°.

The bottom wall 46 of the blast corridor 44 terminates a short distance above the surface 18 and is provided with a resilient skirt 48 which extends therefrom substantially into engagement with the surface 18 and further extends from the housing all about the blast opening to prevent abrasive particles from ricocheting from the blasting housing, while also blocking off the interior of the blast area. The upper wall 50 of the blast corridor terminates at a higher level to define the entrant opening into the rebound corridor 52.

Advantage is taken of the kinetic energy imparted to the abrasive particles striking the surface whereby the abrasive particles rebound from the surface into the upwardly inclined rebound corridor at an angle which is somewhat less than the reflective angle at which the abrasive particles strike the surface.

The rebounding abrasive particles will, for the most part, possess sufficient kinetic energy to climb the walls to the top of the rebound corridor 52.

An important concept of this invention resides in the use of a rebound corridor which extends angularly upwardly, preferably curvilinearly, through an angle of at least 180° with the surface so that, after the abrasive particles have ascended beyond the hump at the top of the corridor, gravitational forces will become effective to assist in the continued movement of the abrasive particles, dusts and fines to the end of the corridor. From there, the materials pass through an air wash 60 communicating with the end of the corridor with the cleaned re-usable abrasive particles falling gravitationally into the supply hopper 38 while the air, with entrained dirt and dusts, is removed from the chamber for further processing.

The rebound chamber is substantially rectangular in cross-section, substantially throughout its length, having a width which corresponds with the width of the blast pattern on the surface to be cleaned and diminishing gradually in the upward direction. In the preferred practice of this invention, the rebound corridor 52 is curved backwardly from the inlet at the bottom to the outlet adjacent the top, with the curvature decreasing in radius from the bottom to the top beginning with a slope corresponding to the reflective angle to the slope of the blast corridor and preferably about 10° to 16° less.

The rebound corridor extends through an angle greater than 180° with the surface and preferably through an angle of 190° to 210° so that the trailing end portion terminates at a downward extending angle of from about 10° to 30°.

Thus the kinetic energy of the particles is used to collect the spent abrasive particles and to carry them through an air wash cycle and return to the feed hopper for re-use.

This eliminates the need for collectors and conveyors otherwise required to recover the abrasive particles and to recycle the re-usable abrasive to the blast wheel. It also eliminates the need to incorporate means for otherwise dissipating the kinetic energy imparted to the abrasive particles by the wheel and it minimizes the excessive wear of surfaces by abrasive whereby frequent repair of replacement is required.

In the modification shown in FIG. 1, the air wash 60 immediately underlies the end of the rebound chamber, beyond the hump. The air wash comprises a series of vertically staggered shelves 64, 66, 68 extending inwardly from opposite side walls 70, 72 with overlapping ends so that the particulate material overflows from an upper shelf onto a lower shelf in a manner to distribute the particulate material so that it will fall as a uniform curtain from the lowermost shelf 68. An air stream is circulated through the curtain from an inlet 74 at one side to an outlet 62 at the other. The air with entrained dusts and fines is conveyed from the outlet 62 to a dust collector (not shown) carried on the frame.

In the modification shown in FIG. 2, use is made of a centrifugal fan 80 having an inlet at the central axis which communicates through duct 82 with an outlet 88 to an expansion chamber. Duct 86 communicates the outlet 84 from a peripheral portion of the centrifugal fan with an inlet 90 on the other sides of the air wash housing.

In operation, abrasive particles, such as steel shot, rebound from the surface 18 through the scroll 52 into the air wash separator 60. Air introduced through the inlet 90 crosses the curtain of abrasive particles and dusts falling from the shelf 68 and entrains the dusts and fines for removal from the abrasive particles. The abrasive particles fall gravitationally into the hopper 38 while the air, with entrained dusts and fines, is removed via duct 91 for transfer to a dust collector. Particulate residue that remains on the surface 18 passes under the skirt 37 (or 48) and is picked up by a vacuum cleaner nozzle 92 for transfer through duct 94 to an expansion chamber 95. In the expansion chamber, the abrasive particles fall gravitationally into the supply hopper 38, while the dusts and fines flow with the air through outlet 88 into duct 82, to the inlet to the fan 80 and pull the air stream which is circulated through the duct 86 to the inlet 90. As described, the dirty air from the air wash goes to the dust collector.

The relatively small amount of abrasive particles which do not traverse the rebound corridor fall back onto the surface and pass under the seal about the blast chamber. These particles are picked up by the trailing auxiliary pickup unit, illustrated in FIG. 2 as a vacuum cleaner 92, but which may otherwise be in the form of a magnetic drum, rotating brush or the like. It will be understood that the power requirement for operating such auxiliary unit to pick up the small amount of abrasive particles remaining on the surface 18 is materially less than the power that would otherwise be required fully to recover the abrasive particles within the blast unit itself.

Since the great majority of the abrasive particles, entrained dusts and fines, rebound with sufficient kinetic energy to pass through the rebound corridor for cleaning and for return of the re-usable abrasive particles to the supply hopper, it is possible markedly to increase the recovery capabilities of the device without placing great reliance on auxiliary recovery systems which can therefore be made to operate simply and efficiently, and without the need to utilize much space or energy for substantially complete recovery of the abrasive particles. The cleaning effect is believed to be derived, at least in part, by the beat of the abrasive particles thrown sequentially by the radially spaced blades of the wheel, while the latter is rotating at high speed.

Instead of making use of gravity feed from the hopper to the wheel, use can be made of other systems for feeding particulate material to the wheel such as a pneumatic feed, screw feed or other means for positive displacement of abrasive material in the desired amounts. Under such circumstances, it is not essential to have the rebound corridor rise to a certain level, although it is preferred that the rebound corridor terminate, at its exit end, in a downward incline so as to be able to take advantage of gravitational forces for continued processing of the recovered particles.

Instead of handle bars 20 or platform 22 being mounted on the rear of the apparatus, it will be understood that such control means can be provided on the opposite end or both ends of the apparatus for enabling movement in either direction.

From the foregoing, it will be apparent that an apparatus is provided for the treatment of surfaces in which utilization is made of kinetic energy resident in the abrasive particles to enable recovery of the abrasive particles in an efficient and economical manner whereby size, weight and cost of the unit can be greatly reduced, while providing greater maneuverability, by hand or by power operated means, over the surface to be treated.

It will be understood that changes may be made in the details of construction, arrangement and operation without departing from the spirit of the invention, especially as defined in the following claims.

I claim:

1. In an abrasive throwing machine comprising an enclosure having an opening therein, means around the opening in said enclosure to retard the escape of spent abrasive from said enclosure, means within the enclosure for protecting abrasive particles along an incident path through said opening onto said surface and from said surface along a rebound path at a substantially mirror angle with said incident path, said projecting means being oriented to establish the incident path at an acute angle with the surface, the improvement wherein the rebound path comprises a continuous curvilinear path, and means for returning spent abrasive from the end of the rebound path to said projecting means.

2. An apparatus as claimed in claim 1 in which the incident angle is within the range of 30° to 80°.

3. An apparatus as claimed in claim 1 which includes a feed hopper for supplying abrasive particles to the projecting means.

4. An apparatus as claimed in claim 3 in which the rebound path rises to a level above the feed hopper for gravitational flow of abrasive particles from the rebound path to the feed hopper.

5. An apparatus as claimed in claim 4 in which the end portion of the rebound path extends downwardly in the direction toward the feed hopper.

6. An apparatus as claimed in claim 4 which includes an air wash between the end of the rebound path and the hopper for the removal of dust and fines from the abrasive particles returned to the hopper.

7. An apparatus as claimed in claim 1 in which the rebound path is in the form of a substantially continuous and unobstructed chamber within the enclosure.

8. An apparatus as claimed in claim 1 in which the opening and the surface to be treated, which underlies the opening, are substantially horizontally disposed and the abrasive particles are projected downwardly through the opening onto the surface and rebound upwardly from the surface through the opening along the rebound path.

9. An apparatus as claimed in claim 1 in which the rebound path gradually diminishes in cross section substantially throughout its length from adjacent the opening.

* * * * *